US005106220A

United States Patent [19]

Ricca et al.

[11] Patent Number: 5,106,220

[45] Date of Patent: Apr. 21, 1992

[54] GUIDE AND COVER ARRANGEMENT FOR PRINTERS

[75] Inventors: Aldo Ricca, Rivarolo Canavese; Renato Marangon, Borgofranco d'Ivrea, both of Italy

[73] Assignee: Ing. Olivetti & C., S.p.A., Ivrea, Italy

[21] Appl. No.: 547,303

[22] Filed: Jul. 3, 1990

[30] Foreign Application Priority Data

Aug. 21, 1989 [IT] Italy ..... 67711 A/89

[51] Int. Cl.[5] ..... B42J 29/02

[52] U.S. Cl. ..... 400/693; 400/690.1; 400/694; 346/145

[58] Field of Search ..... 400/690-694; 346/145; 312/208

[56] References Cited

U.S. PATENT DOCUMENTS

| | | | |
|---|---|---|---|
| 4,340,315 | 7/1982 | Teichmann et al. | 400/694 |
| 4,568,211 | 2/1986 | Fox et al. | 400/690.4 |

FOREIGN PATENT DOCUMENTS

| | | | |
|---|---|---|---|
| 0063466 | 4/1986 | Japan | 400/691 |
| 0172764 | 8/1986 | Japan | 400/693 |
| 0080080 | 4/1987 | Japan | 400/690.1 |
| 0174174 | 7/1987 | Japan | 400/693 |

*Primary Examiner*—Edgar S. Burr
*Assistant Examiner*—Christopher A. Bennett
*Attorney, Agent, or Firm*—Banner, Birch, McKie & Beckett

[57] ABSTRACT

A body structure for a printer comprises a front cover and a rear cover and is capable of accommodating a platen roller a typing device and advance means for advancing and feeding individual or continuous forms. A hinge element fixed to a pillar of the body structure permits pivotal movement of the covers and such that the front cover can rotate from a first operating position in which it is parallel to and supported on the body structure to a second operating position in which it is substantially turned over onto the rear cover to permit access to the platen roller and the typing device. In addition the hinge element permits the rear cover to rotate from a first operating position in which it is substantially parallel to and supported on the body structure to a second operating position in which it is substantially inclined with respect to the body structure. The forms can be supported and guided by the outside surface of the rear cover in both operating positions. In a third operating position thereof the rear cover is capable of being turned over into the front cover to permit access to the advance means. The body structure also comprises a transparent intermediate cover member pivotally mounted on the front cover to protect and silence the typing and printing zone and a transparent rear cover member pivotally mounted on the intermediate cover to protect the forms in both the operating positions of the rear cover. The intermediate member has positioning means to hold it in an inclined position on the rear cover in both its operating positions, and guide means for guiding the forms. The rear member has spacer means to space it from the rear cover.

15 Claims, 5 Drawing Sheets

GUIDE AND COVER ARRANGEMENT FOR PRINTERS

BACKGROUND OF THE INVENTION

The present invention relates to a guide and cover arrangement for printers of the type having a body structure with a main body portion capable of accommodating a platen roller, a typing device and advance means adjacent to the roller for advancing individual and continuous forms, in which said arrangement comprises a transparent cover member for protecting the typing and printing zone, and a rear cover which is pivoted to the main body portion and which is capable of movement between two operating positions in which, in a first operating position, the rear cover is substantially parallel to and supported on the main body portion of the body structure and, in the second operating position, said rear cover is substantially inclined with respect to the main body portion of the body structure, and wherein said forms are capable of being supported on and guided by the rear cover in both the operating positions.

U.S. Pat. No. 4,806,035 discloses a guide and cover arrangement for printers of that type in which the rear cover comprises a guide plate which is movable from the first position in which it is in contact with the upper part of the body structure to the second position in which it is inclined with respect to the body structure and is held in the second position by a suitable frame. The transparent cover member is fixedly mounted on the front part of the body structure to cover the typing zone without interfering with the movement of the rear cover. That guide and cover arrangement suffers from various disadvantages, in particular the typing zone is not sufficiently covered and protected from any foreign bodies, printing is not silenced and in addition the forms which slide over the guide body in both positions are not adequately guided.

U.S. Pat. No. 4,828,417 discloses another guide and cover arrangement for printers in which the body structure internally houses an automatic sheet feeder. To extract the feeder and render it operative, it is necessary to open the rear cover and then position the feeder in its operative position. That arrangement also involves disadvantages. In particular the printer is of substantial bulk, by virtue of having to accommodate the automatic feeder in its interior, and in addition the path involved in feed movement of the forms, when the feeder is not in operation and is positioned within the body structure, is complicated and can give rise to blockages in the feed movement of the forms themselves.

SUMMARY OF THE INVENTION

An object of the present invention is therefore to provide a guide and cover arrangement for printers, which is simple, reliable and has a sufficient damping capability for the printing noise and which at the same time is very easy to use, practical and low in cost.

In the guide and cover arrangement for printers according to the invention, said transparent cover member comprises an intermediate portion pivotally mounted on the front part of the body structure. The intermediate portion has positioning means co-operating with said rear cover to hold said intermediate portion in an inclined position with respect to said rear cover in both the operating positions, and guide means capable of guiding the forms from the typing and printing zone along a predetermined path on said rear cover. The cover further includes a rear portion which is pivotally mounted on said intermediate portion and comprises spacing means co-operable with said rear cover for being held constantly spaced from the rear cover in both said operating positions.

The front cover is movable to a position in which it is turned over onto the rear cover to permit access for the typing device and the platen roller, and is hinged to the body structure by a plastics hinge having a bendable portion of limited thickness. The rear cover is movable to between its said operating positions by means of a plastics hinge having a bendable portion of limited thickness, and also can be moved to a further position in which it is substantially turned over onto the front portion of the body structure.

BRIEF DESCRIPTION OF THE DRAWINGS

A preferred embodiment of the present invention is set forth in the following description which is given by way of non-limiting example with reference to the accompanying drawings in which.

DETAILED DESCRIPTION OF THE PREFERRED EMBODIMENT

Figure 1:
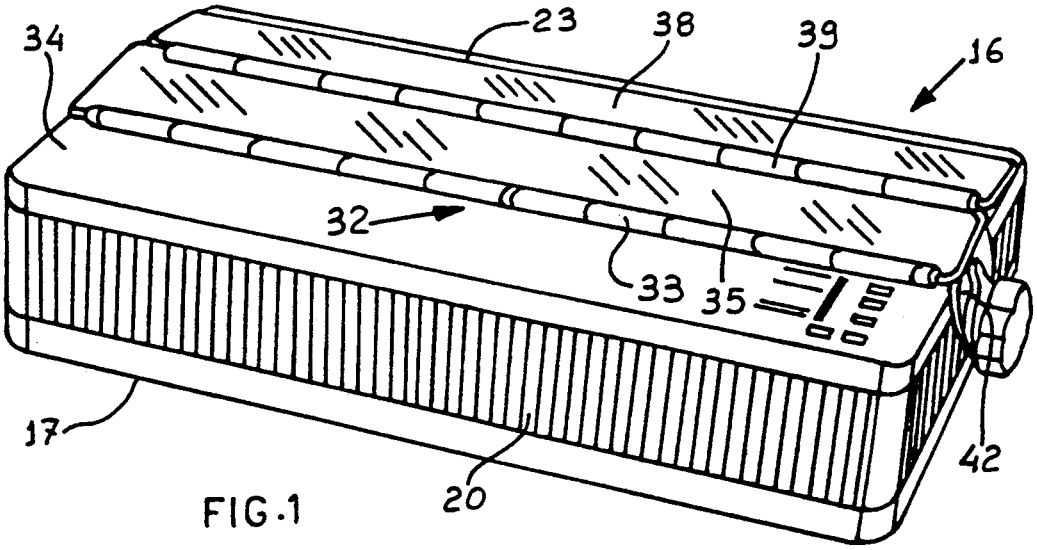
FIG. 1 is a perspective view from the front right of a printer with a guide and cover arrangement according to the invention.
Figure 4:
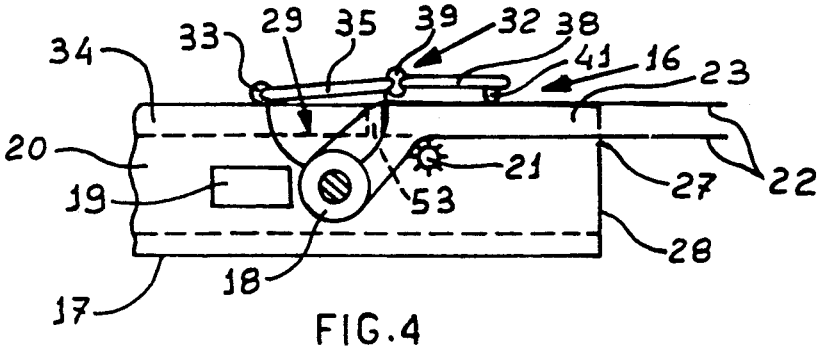
FIG. 4 is a diagrammatic side view in a first operating position of the arrangement shown in FIG. 1.
Figure 5:
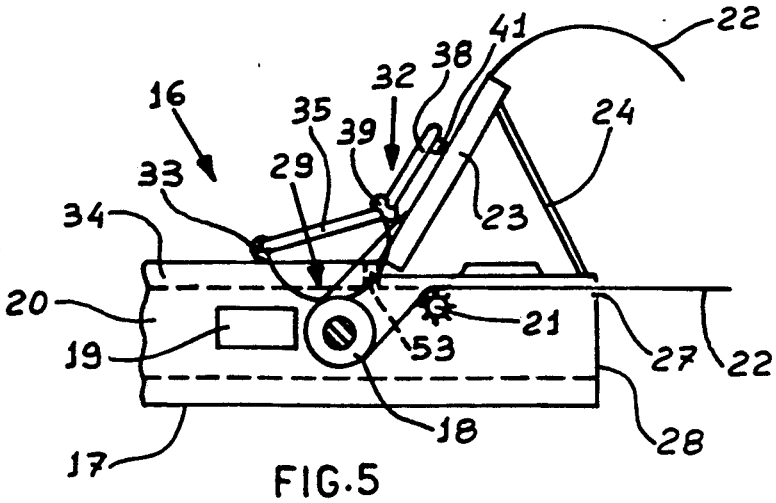
FIG. 5 is a diagrammatic side view in a second operating position of the arrangement shown in FIG. 1.
Figure 9:
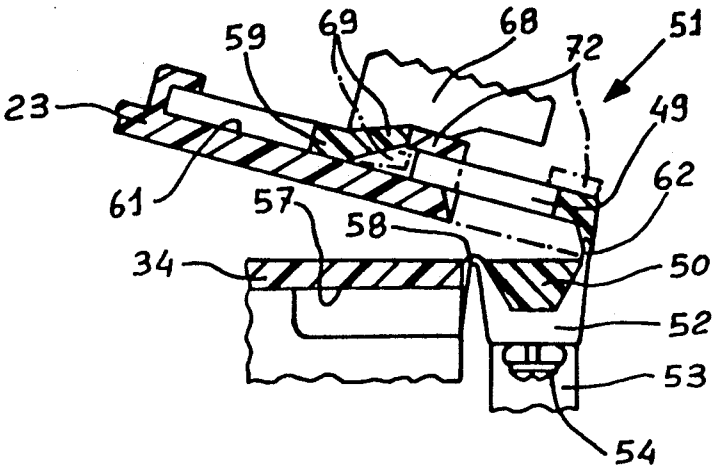
FIG. 9 is a partial side view of the details from FIG. 8 in an operating position.

Referring to FIGS. 1, 4 and 5, the printer is generally indicated by reference numeral 16 and comprises a body structure 17 having a main body portion 20 arranged to accommodate a platen roller 18, a typing device 19, and advance means 21 comprising a pin wheel for advancing the platen roller 18 and feeding individual (single sheet) and continuous forms 22. The platen roller 18, the typing device 19 and the advance means 21 are known per se and are only diagrammatically shown in order not to complicate the description and drawings. In particular the typing device 19 may be of the daisywheel impact type, with a needle printing head or with impactless typing devices of the thermal or ink jet type.

Figure 2B:
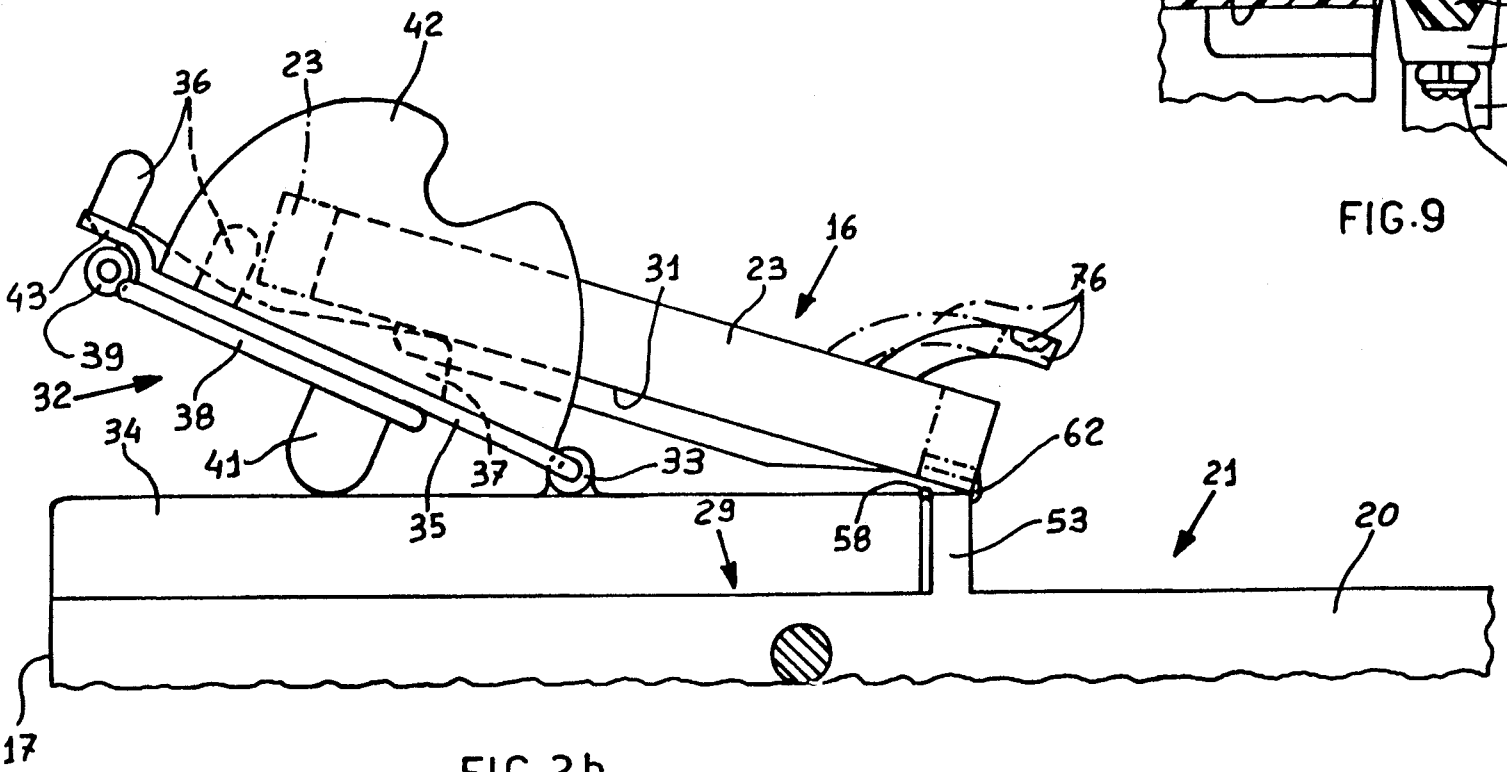
FIGS. 2*a* and 2*b* show two side views of some parts of the arrangement shown in FIG. 1 on a different scale and in different operative conditions.
Figures 2A, 8:
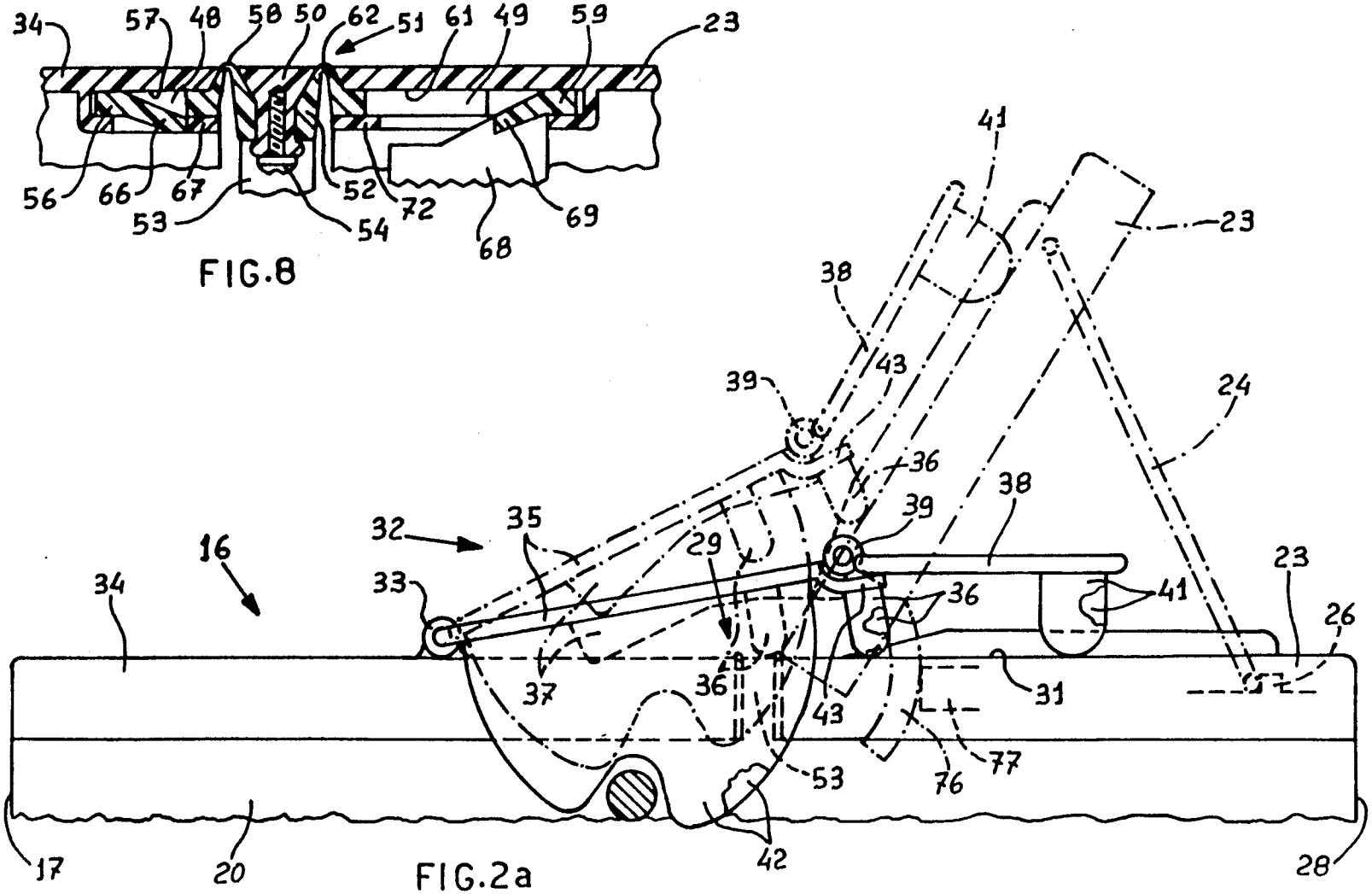
FIG. 8 is a partly sectional side view of some details from FIG. 1 on an enlarged scale.

The body structure 17 (see FIGS. 1, 2*a*, 2*b*, 3, 4 and 5) comprises a rear cover 23 which is pivotally mounted with respect to the main body portion 20 and which is movable between two operating positions. In its first operating position the cover 23 is substantially parallel to and supported on the main body portion 20 while in its second operating position the cover 23 is substantially inclined with respect to the body portion 20 and can be held in that position by means of a support frame 24 which is engaged with a fixed shoulder 26 on the body structure 17. In FIG. 2*a* the rear cover 23 is shown in its first operating position in solid line and in its second operating position in dash-dotted line.

The forms 22 pass into the printer 16 by way of a slit 27 in the rear portion 28 of the body structure 17, are advanced by the advance means 21 beneath the platen roller 18, then pass into the typing and printing zone 29, issue from the printer 16 and are supported and guided on the upper outside surface 31 of the rear cover 23 in both the operating positions thereof.

A transparent cover member 32 comprises an intermediate portion 35 pivotally mounted at 33 on a front cover 34 of the body structure 17 and positioning means 36 formed by two pairs of tongues with free ends of a semicylindrical configuration, co-operating with the outside surface 31, sliding over same to hold the transparent cover member 32 in an inclined position with respect to the rear cover 23 in the two operating positions. The transparent cover member 32 protects the typing and printing zone 29 and silences the noise at that zone when using impact-type printing.

The cover member 32 comprises guide means 37 which direct the forms 22 from the typing and printing zone 29 towards the outside surface 31 of the rear cover 23 and a rear portion 38 pivotally mounted at 39 on the intermediate portion 35. The guide means 37 comprise a series of ribs projecting downwardly from the intermediate portion 35 and having saddle-shaped bottom edges which define a fixed path for guiding the forms 28 from the platen roller 18 to the cover 23. A guide plate portion 43 projecting from the rear end of the portion 35 at the underside thereof finally ensures that the forms 22 do not interfer with the pivot mounting 39 between the portions 35 and 38.

The rear portion 38 of the cover member 32 comprises spacer means 41 formed by a pair of tongues having free ends of a semicylindrical configuration, co-operating with the outside surface 31 by sliding thereover in such a way that the portion 38 is always disposed at a spacing from and parallel to the rear cover 23 in both the operating positions of the cover 23. The intermediate portion 35 of the transparent cover member 32 comprises two side tongues 42 projecting along the sides of the body structure 17 to protect the typing and printing zone 29 in both the operating positions of the rear cover 23.

The rear portion 38 of the transparent cover member 32 can rotate, so as to be positioned in inverted relationship in contact with and parallel to the intermediate portion 35. The portion 35 is however still free to rotate, so as to be positioned in inverted relationship with the tongues 41 of the portion 38 bearing against the front cover 34, as shown in solid line in FIG. 2*b*, to permit access to the typing and printing zone 29. Similarly the rear cover 23 is capable of assuming a third operating position in which it is substantially turned over onto the front cover 34, being arrested against the guide means 37, as shown in solid line in FIG. 2*b*, to permit access to the advance means 21.

The front cover 34 (see FIGS. 1, 2*a*, 2*b*, 3 and 4) is movable from a first position in which it is parallel to and supported on the main body portion of the body structure 17 to a second position in which it is turned over onto the rear cover 23 to permit access to the platen roller 18 and the typing device 19. During that positioning of the front cover 34, the rear portion 38 of the transparent cover member 32 can occupy two different positions. Normally the two front and rear covers 34 and 23 are in their first position in which they are supported on the body structure 17 and the two transparent portions 35 and 38 are positioned with the positioning and spacer means 36 and 41 respectively on the external surface 31.

When the front cover 34 is moved from the first position to the second position, the two portions 35 and 38 of the transparent cover member 32 slide with the positioning and spacer means 36 and 41 over the outside surface 31 until the front cover 34 reaches the second position thereof, in which the rear portion 38 is completely projecting from the body structure 17 and remains supported on the plate portion 43 of the intermediate portion 35 of the transparent cover member 32. In that first position the cover member 32 can be obstructive and the rear portion 38 may possibly collide with objects positioned adjacent to the printer 16.

Figure 3:
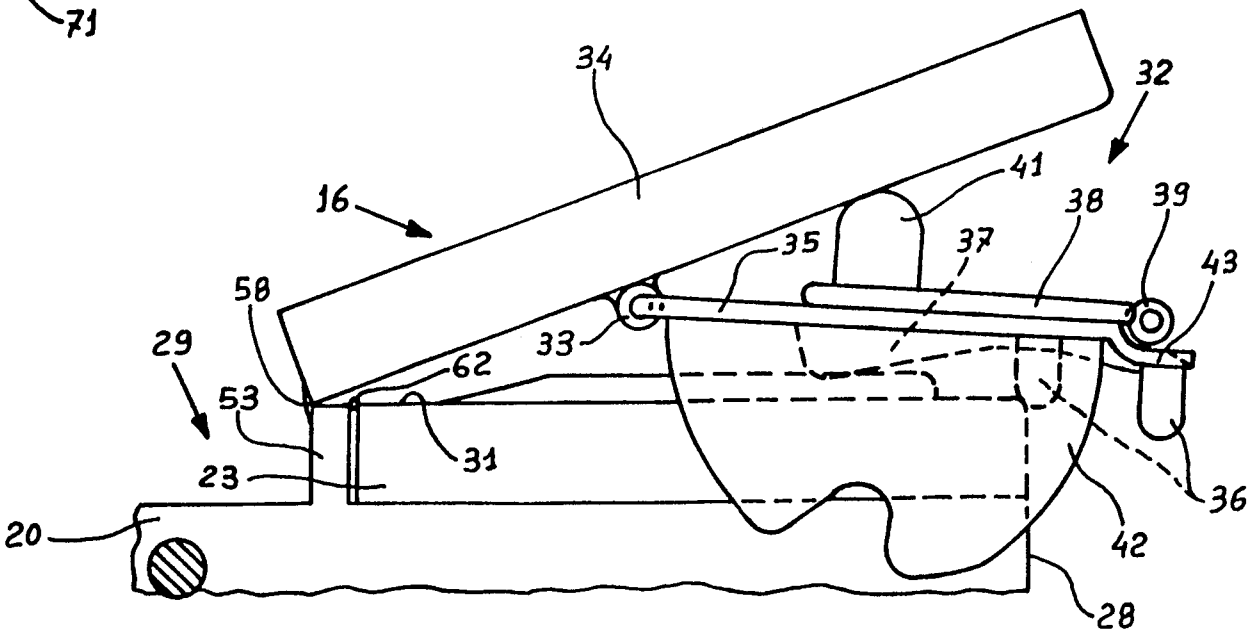
FIG. 3 is a side view of other parts of the arrangement shown in FIG. 1 on a different scale.
Figure 10:
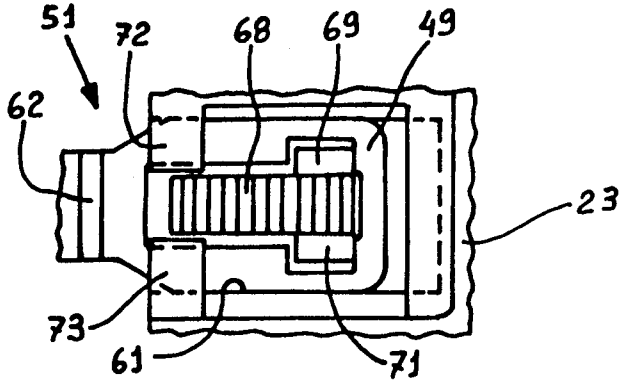
FIG. 10 is a partial plan view of some details from FIG. 8 in an inverted position.

In order to prevent the possibility of the portion 38 being damaged or damaging other objects, the operator, prior to initiating the movement of the rear cover 34 towards its second position, causes the rear portion 38 of the transparent cover member 32 to rotate, with a turning-over movement, into a position in contact with and parallel to the intermediate portion 35. When the front cover 34 is then rotated, the intermediate portion 35 slides with the positioning means 36 over the outside surface 31 of the rear cover 23 until the front cover 34 reaches its second position in which it is supported against the spacer means 41 of the portion 38, as shown in FIG. 3. In that second position of the cover 34, the cover member 32 in its turned-over position will be much less obstructive with respect to the first position since it is only the pivot mounting 39 of the intermediate portion 35 that will project from the body structure 17, as can be seen from FIG. 3.

The covers 23 and 34 are connected to the sides of the main body portion 20 of the body structure 17 by means of two hinge elements which are generally indicated at 51 (see FIGS. 1, 2*a*, 2*b*, 8, 9 and 10). Each hinge element 51 is formed from a single portion of plastics material, of elongate rectangular shape comprising an intermediate portion 52 and two arms 48 and 49 connected to the intermediate portion 52 by means of two thin portions which are flexible and which define a first pivot element 58 and a second pivot element 62. The intermediate portion 52 of the element 51 is fixed in known manner to a transverse portion 50 which in turn is in one piece with pillar 53 of the body portion 20, for example by means of a screw 54. The arm 48 of the hinge element 51 comprises at one end a first latching engagement portion 56 removably fixed in a seat 57 in the front cover 34 and the arm 49 comprises at the other end a second latching engagement portion 59 removably fixed in a seat 61 of the rear cover 23. The first pivot element 58 and the second pivot element 62 permit the respective front and rear covers 34 and 23 to rotate with respect to the body portion 20 to be positioned in their various operating positions as described hereinbefore. In the first operating position of the covers 34 and 23, the arms 48 and 49 are positioned in a condition of horizontal alignment with the intermediate portion 52 and the pivot elements 58 and 62 are of an inverted tight U-shaped configuration such that the axes of rotation of the covers 34 and 23 are parallel and substantially coplanar with the upper horizontal surface of the transverse portion 50.

The first latching engagement portion 56 is accommodated in the seat 57 of the front cover 34 and comprises a flexible latch 66 which is normally locked against a shoulder 67 of the seat 57. To remove the front cover 34 from the body structure 17, it is only necessary to press against the flexible latch 66, disengaging it from the shoulder 67, and then pull the front cover 34 outwardly of the body structure 17. With that movement the seat 57 is disengaged from the respective first latching portion 56. To refit the front cover 34, the seat 57 is disposed in a position corresponding to the first latching engagement portion 56 and the front cover 34 is then urged rearwardly. The internal edge of the seat 57 slides on the outside of the latch 66, bending it until the first latching engagement portion 56 springs into its seat 57. The latch 66 is now free to return to its original position of bearing against the shoulder 67.

The second latching engagement portion 59 is accommodated in the seat 61 of the rear cover 23 and comprises a central presser portion 68 which projects from the second latching engagement portion 59 and which has two flexible latches 69 and 71 which are positioned laterally with respect to the presser portion 68. The seat 61 of the cover 23 comprises two lateral shoulders 72 and 73 which are spaced from each other to allow the presser portion 68 to pass therebetween. The two lateral shoulders 72 and 73 are spaced from the respective latches 69 and 71 to permit the rear cover 23, when in its third operating position, to slide towards the front cover 34 into a fourth position indicated in dash-dotted line in FIG. 2*b* until the shoulders 72 and 73 (see FIG. 9) are locked against the corresponding latches 69 and 71 of the hinge element 51 to permit better access to the advance means 21 of the printer as shown in FIG. 2*b*.

To remove the rear cover 23 from the body structure 17, from the fourth position thereof, it is only necessary to press against the presser portion 68, bending the latches 69 and 71 and thus disengaging them from the shoulders 72 and 73 of the cover 23. To refit the rear cover 23 the seat 61 is disposed in a position corresponding to the second latching engagement portion 59 and then the rear cover 23 is urged forwardly. The internal edge of the shoulders 72 and 73 slides on the outside against the latches 69 and 71, bending them, until the width of the shoulders 72 and 73 has been surpassed, and then the latches 69 and 71 spring back into their original position. The structural difference between the latching engagement portions 56 and 59 means that the covers 34 and 23 cannot be interchanged during the assembly operation.

In the vicinity of the seats 61 the rear cover 23 comprises two lower projections 76 which are each in the form of a sector of a circle and which are positioned at the sides of the cover and which have their centre of curvature at the elements 62. The projections 76 co-operate with two respective shoulders 77 on the main body portion 20 to guide the rear cover 23 in its movement from the first operative position to the second operative position and vice-versa but which are disengaged from the shoulders 77 in the third operative position of the cover 23. The projections 76 and the shoulders 77 ensure that the cover 23 cannot move rearwardly with respect to the elements 62 during the reciprocal movements thereof for moving it into the first and second operative positions.

Figures 6, 7:
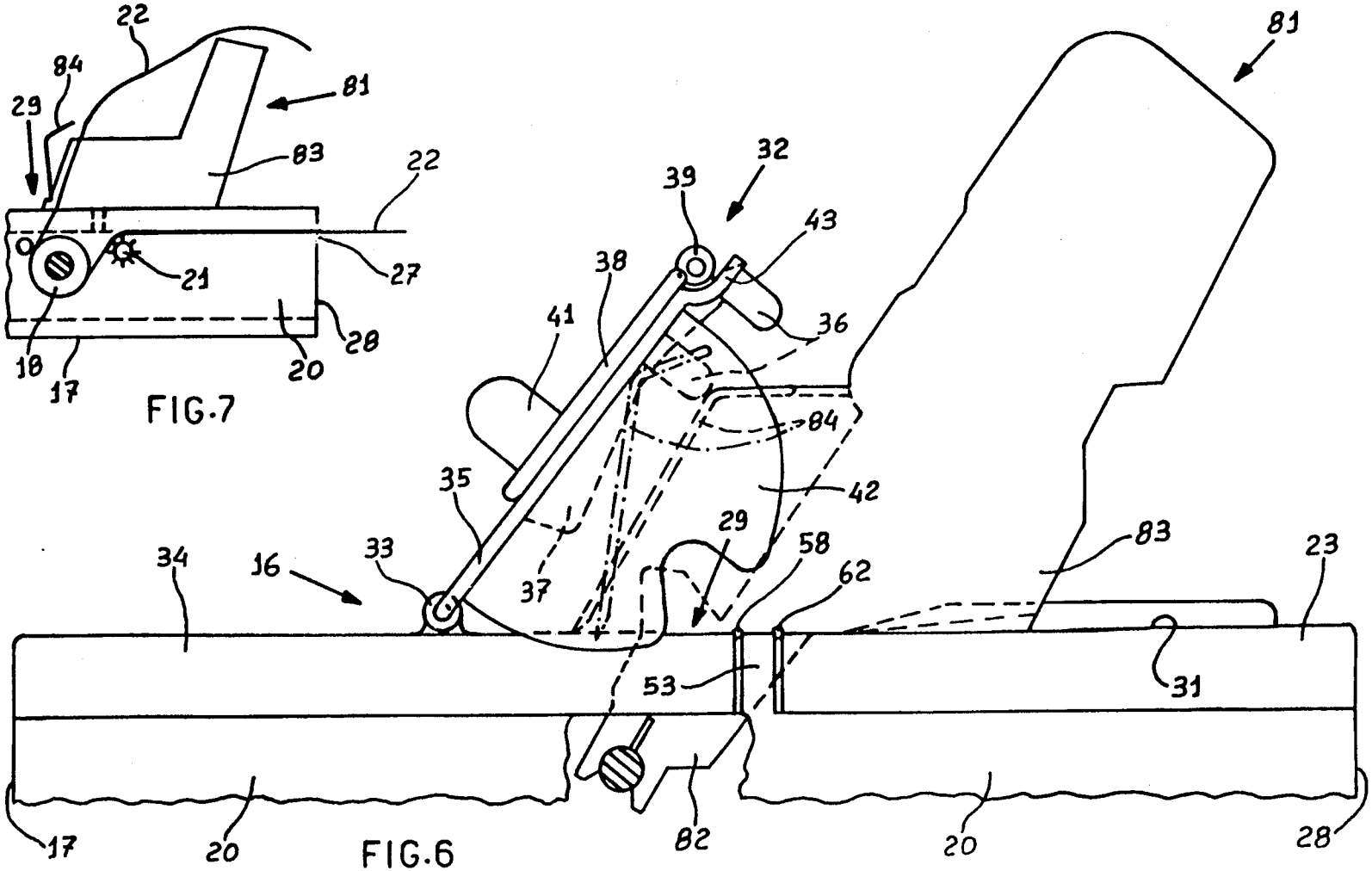
FIG. 6 is a side view of successive parts of the arrangement shown in FIG. 1 on a different scale.
FIG. 7 is a diagrammatic side view in a subsequent operating position of the arrangement shown in FIG. 1.

An automatic sheet feeder generally indicated at 81 (see FIGS. 6 and 7) may be mounted on the body structure 17 of the printer 16, the sheet feeder having a front portion 82 capable of being inserted into the typing and printing zone 29 to co-operate with the platen roller 18 and the advance means 21, and a rear portion 83 capable of bearing against the outside surface 31 of the rear cover 23. The intermediate portion 35 of the transparent cover member 32 is supported against the side edge of the feeder 81 by way of the positioning means 36 and thus permits a cover 83 of the feeder 81 to move freely. The feeder 81 is known per se and has been shown diagrammatically in order not to complicate the description and drawings.

It will be apparent that the invention is not limited to the illustrated printer guide and cover arrangement which has been described hereinbefore, but various modifications and additions of parts and other improvements may be made therein without departing from the scope of the present invention as defined in the claims.

What we claim is:

1. In a printer of the type having a body structure with a front position and a main body portion capable of accommodating a platen roller, a typing device, and advance means adjacent to the platen roller for advancing individual and continuous forms, a guide and cover arrangement for said printer, said arrangement comprising:

a rear cover pivotally mounted on the main body portion and capable of movement between two operating positions and in which, in a first of said operating positions, said rear cover is substantially parallel to and supported on the main body portion of the body structure and, in the second operation position, said rear cover is substantially inclined with respect to the main body portion of the body structure, and whereby the forms are capable of being supported on and being guided by the rear cover in both said operating positions; and a transparent cover member for protecting the typing and printing zone and comprising an intermediate portion pivotally mounted on the front portion of the body structure, and having positioning means co-operating with said rear cover to hold said intermediate portion in an inclined position with respect to said rear cover in both the operating positions, and guide means capable of guiding the forms from the typing and printing zone along a predetermined path on said rear cover, and a rear portion pivotally mounted to said intermediate portion and comprising spacer means co-operable with said rear cover to be held constantly spaced from the rear cover in both said operating positions.

2. A guide and cover arrangement according to claim 1 in which the intermediate portion of the transparent cover member comprises two lateral tongues projecting along the sides of the body structure to protect said typing and printing zone in both the operating positions of said rear cover.

3. A guide and cover arrangement according to claim 1 in which said spacer means hold the rear portion of the transparent cover member parallel to said rear cover and co-operate with an upper surface of said rear cover for automatically positioning and guiding said rear portion during the movement necessary for positioning said rear cover from the first operating position to the second operating position and vice-versa.

4. A guide and cover arrangement according to claim 3 in which said spacer means comprise two tongues projecting from the rear portion of the transparent cover member and each having their free end of substantially cylindrical configuration capable of sliding over the upper surface of said rear cover.

5. A guide and cover arrangement according to claim 3, in which the intermediate portion of the transparent cover member comprises two lateral tongues projecting along the sides of the body structure to protect said typing and printing zone in both the operating positions of said rear cover.

6. A guide and cover arrangement according to claim 5 in which, when the intermediate portion and the rear portion of said transparent cover member are inverted, said rear cover is movable into a third operating position in which it is substantially turned over towards the front portion of the body structure to permit access to the advance means for advancing said forms.

7. In a printer of the type having a body structure provided with a front cover and capable of accommodating a platen roller, a typing device, and advance means for advancing individual and continuous forms, a guide and cover arrangement for said printer, said arrangement comprising:

a rear cover movable from a first operating position in which it is substantially parallel to and is supported on the body structure to a second operating position in which it is substantially inclined with respect to the body structure and whereby the forms are supported and guided by an external upper surface of the rear cover in both the operating positions; and a transparent cover member for protecting the typing and printing zone pivotally mounted on the front cover of the body structure and comprising positioning means co-operating with the outside surface of the rear cover to hold said transparent cover member in an inclined position with respect to said rear cover in both the operating positions; and in which it is parallel to and supported on the body structure to a second position in which it is turned over onto said rear cover to permit access to the typing device and the platen roller.

8. A guide and cover arrangement according to claim 7 in which said positioning means comprise at least one pair of tongues projecting from the transparent cover member and each having its free end of a substantially semicylindrical configuration capable of sliding over the outside surface of said rear cover.

9. A guide and cover arrangement according to claim 8 in which said at least one pair of tongues is positioned at the end opposite to the pivot mounting of said transparent cover member.

10. A guide and cover arrangement according to claim 9 in which said transparent cover member comprises two portions of which an intermediate portion is pivotally mounted to the front cover and a rear portion which is pivotally mounted to said intermediate portion adjacent to said pair of tongues and comprises spacer means co-operating with said outside surface of the rear cover to hold said rear portion always parallel to said rear cover in both the operating portions of said rear cover.

11. A guide and cover arrangement according to claim 10 in which said spacer means comprise a pair of tongues positioned at the free end of the rear portion of said transparent cover member and each being of a substantially semicylindrical configuration to slide over the outside surface of said rear cover in both the operating positons of said rear cover.

12. A guide and cover arrangement according to claim 8 in which said spacer means comprise a pair of tongues positioned at the free end of the rear portion of said transparent cover member and each being of a substantially semicylindrical configuration to slide over the outside surface of said rear cover in both the operating positions of said rear cover, and the pair of tongues of the intermediate portion and the pair of tongues of the rear portion of said transparent cover member slide over the outside surface of said rear cover when said front cover is movable from the first position to the second position and vice-versa.

13. A cover assembly for a printer, comprising:

a front cover pivotable along its rear edge for movement from a closed position upwardly and rearwardly to an open position, a rear cover rearward of the front cover pivotable along its front edge for movement from a closed, first operative position upwardly to a second operative position, and a two-part transparent member a first panel of which has a first edge pivoted on an intermediate portion of the front cover such that when the front cover is closed the opposed second edge of the first part fo the transparent member can overlie the forward portion of the rear cover, and a second panel of the transparent member being pivoted to the second edge of the first panel.

14. A cover assembly according to claim 13, in which the rear cover is further movable forwardly to an open position.

15. A cover assembly according to claim 13, in which the second panel is pivoted along its front edge to the second edge of the first panel and has a rear edge which overlies the rearward portion of the rear cover when the front cover is closed and the rear cover is in its second operative position.

* * * * *